US008963906B2

(12) United States Patent
Oh

(10) Patent No.: US 8,963,906 B2
(45) Date of Patent: Feb. 24, 2015

(54) DISPLAY DEVICE USING A CHARGE SHARING UNIT AND METHOD FOR DRIVING THE SAME

(71) Applicant: LG Display Co., Ltd., Seoul (KR)

(72) Inventor: Dae-Seok Oh, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 95 days.

(21) Appl. No.: 13/673,919

(22) Filed: Nov. 9, 2012

(65) Prior Publication Data

US 2013/0120349 A1 May 16, 2013

(30) Foreign Application Priority Data

Nov. 15, 2011 (KR) ..... 10-2011-0118744

(51) Int. Cl.
*G09G 5/00* (2006.01)
*G09G 3/36* (2006.01)

(52) U.S. Cl.
CPC ..... *G09G 3/3685* (2013.01); *G09G 3/3688* (2013.01); *G09G 2310/0251* (2013.01); *G09G 3/3614* (2013.01); *G09G 2310/0248* (2013.01); *G09G 2310/027* (2013.01); *G09G 2310/0297* (2013.01)
USPC ..... 345/211; 345/96

(58) Field of Classification Search
CPC . G09G 3/3614; G09G 3/3648; G09G 3/3688; G09G 2310/0251; G09G 2310/0248
USPC ..... 345/87, 211, 96
See application file for complete search history.

(56) References Cited

U.S. PATENT DOCUMENTS 6,271,816 B1 8/2001 Jeong et al.
2003/0174119 A1 * 9/2003 Nishi et al. ..... 345/100

FOREIGN PATENT DOCUMENTS

JP 2001-515225 A 9/2001
JP 2003-228353 A 8/2003
JP 2003-271105 A 9/2003
JP 2008-116556 A 5/2008
WO WO 99/12072 A2 3/1999

OTHER PUBLICATIONS

Japanese Patent Office, Office Action, Japanese Patent Application No. 2012-246984, Oct. 22, 2013, four pages.

* cited by examiner

*Primary Examiner* — Chanh Nguyen
*Assistant Examiner* — John Kirkpatrick
(74) *Attorney, Agent, or Firm* — Fenwick & West LLP

(57) ABSTRACT

A display device and a method for driving the same are disclosed. The disclosed display device includes a display panel for displaying an image corresponding to a plurality of data signals transferred via a plurality of data lines, a data driver for driving the plurality of data lines, a timing controller for controlling driving timing of the data driver, and a charge sharing unit comprising a first charger allocated to a first data line group of the plurality of data lines, and a second charger allocated to a second data line group of the plurality of data lines, the charge sharing unit selectively performing charging and discharging operations among the first data line group, the first charger, the second data line group and the second charger under control of the timing controller.

4 Claims, 3 Drawing Sheets

DISPLAY DEVICE USING A CHARGE SHARING UNIT AND METHOD FOR DRIVING THE SAME

CROSS REFERENCE TO RELATED APPLICATIONS

This application claims the benefit of the Korean Patent Application No. 10-2011-0118744, filed on Nov. 15, 2011, which is incorporated by reference herein in its entirety.

BACKGROUND OF THE INVENTION

1. Field of the Invention

The present invention relates to a display device, and more particularly, to a technology for achieving charge sharing of data lines.

2. Discussion of the Related Art

Various flat display devices capable of overcoming drawbacks of a cathode ray tube (CRT) display device, namely, heavy and bulky structures, have been proposed. Examples of flat display devices include a liquid crystal display device, a field emission display device, a plasma display panel, an organic electroluminescent display device or the like.

In particular, the liquid crystal display device includes a liquid crystal panel for displaying an image, and a driving unit for driving the liquid crystal panel. The driving unit includes a gate driver for driving a plurality of gate lines, a data driver for driving a plurality of data lines, and a timing controller for controlling the gate driver and data driver. Meanwhile, if a constant voltage is continuously applied to a liquid crystal cell of the liquid crystal panel, the liquid crystal cell may be degraded. To this end, an inversion driving method is employed. Examples of inversion driving methods include a frame inversion driving method, a line inversion driving method, a column inversion driving method, and a dot inversion driving method. However, when the liquid crystal panel is driven in accordance with the above-mentioned inversion driving method, there is high power consumption because the polarity of a data signal is repeatedly inverted. To this end, the data lines are charged with a voltage having an intermediate level between a positive data signal and a negative data signal, using a charge sharing circuit, in order to reduce a voltage variation width among the data lines.

For recently-developed liquid crystal panels, which operate at an increased driving frequency, however, it is difficult to secure a sufficient time to achieve charge sharing among data lines, using a general charge sharing method of electrically connecting the data line charged with positive data and the data line charged with negative data, to equalize the potentials of the two data lines.

SUMMARY OF THE INVENTION

Accordingly, the present invention is directed to display devices and methods for driving the same that are capable of achieving charge sharing within a reduced time, through chargers allocated to respective data line groups.

Additional advantages, objects, and features of disclosed embodiments are set forth in the description which follows and variations thereof will become apparent to those having ordinary skill in the art upon examination of the following or may be learned from practice of the invention. The objectives and other advantages of the embodiments may be realized and attained by the structure particularly pointed out in the written description and claims hereof as well as the appended drawings.

To achieve these objects and other advantages an embodiment of a display device includes a display panel for displaying an image corresponding to a plurality of data signals transferred via a plurality of data lines, a data driver for driving the plurality of data lines, a timing controller for controlling driving timing of the data driver, and a charge sharing unit comprising a first charger allocated to a first data line group of the plurality data lines, and a second charger allocated to a second data line group of the plurality data lines, the charge sharing unit selectively performing charging and discharging operations among the first data line group, the first charger, the second data line group and the second charger under control of the timing controller.

The charge sharing unit may include a first switching group for selectively connecting the data driver and the plurality of data lines, a second switching group for selectively connecting the first data line group and the first charger, a third switching group for selectively connecting the second data line group and the second charger, the first charger coupled, at one end thereof, to the first data line group via the second switching group, the first charger receiving, at the other end thereof, a first control voltage for supplying or removing charge from the second data line group, and the second charger coupled, at one end thereof, to the second data line group via the third switching group, the second charger receiving, at the other end thereof, a second control voltage for supplying or removing charge from the second data line group.

In another aspect, a display device includes a display panel for displaying an image corresponding to a plurality of data signals transferred via a plurality of data lines, a data driver for driving the plurality of data lines, a timing controller for controlling driving timing of the data driver, and a charge sharing unit comprising a first charger allocated to a first data line group of the plurality data lines, and a second charger allocated to a second data line group of the plurality data lines, the charge sharing unit selectively performing charging and discharging operations between the first data line group and the first charger and charging and discharging operations between the second data line group and the second charger under control of the timing controller, wherein a positive control voltage and a negative control voltage are selectively applied to the first charger and the second charger, to cause the first charger and the second charger to perform voltage boosting.

The charge sharing unit may include a first switching group for selectively connecting the data driver and the plurality data lines, a second switching group for selectively connecting the first data line group and the first charger, a third switching group for selectively connecting the second data line group and the second charger, the first charger coupled, at one end thereof, to the first data line group via the second switching group, the first charger receiving, at the other end thereof, a first control voltage for supplying or removing charge from the second data line group, and the second charger coupled, at one end thereof, to the second data line group via the third switching group, the second charger receiving, at the other end thereof, a second control voltage for supplying or removing charge from the second data line group.

In another aspect, a method for driving a display device including a first charger electrically coupled to a first data line group of a plurality of data lines, and a second charger electrically coupled to a second data line group of the plurality of data lines includes the steps of applying a positive control voltage to the first charger for raising a voltage level of the first data line group, driving the positive data signal onto the first data line group, applying a negative control voltage to the first charger for lowering the voltage level of the first data line group, and driving the negative data signal onto the first data line group.

The method may further include the steps of applying the negative control voltage to the second charger for lowering a voltage level of the second data line group, driving the negative data signal onto the second data line group, applying the positive control voltage to the second charger for raising the voltage level of the second data line group, and driving the positive data signal onto the second data line group.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
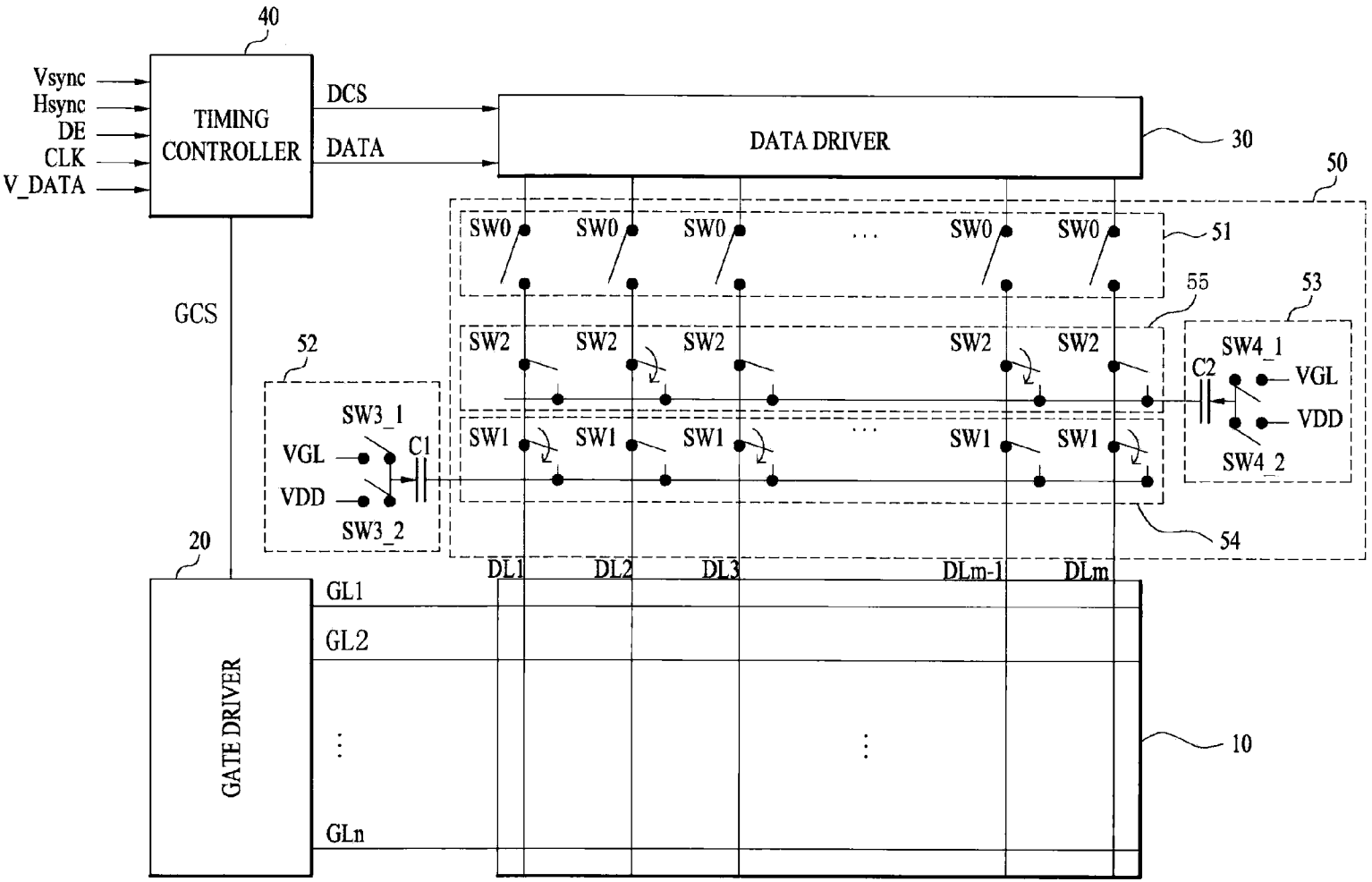
FIG. 1 is a block diagram illustrating a configuration of a display device according to an exemplary embodiment of the present invention.
Figure 2:
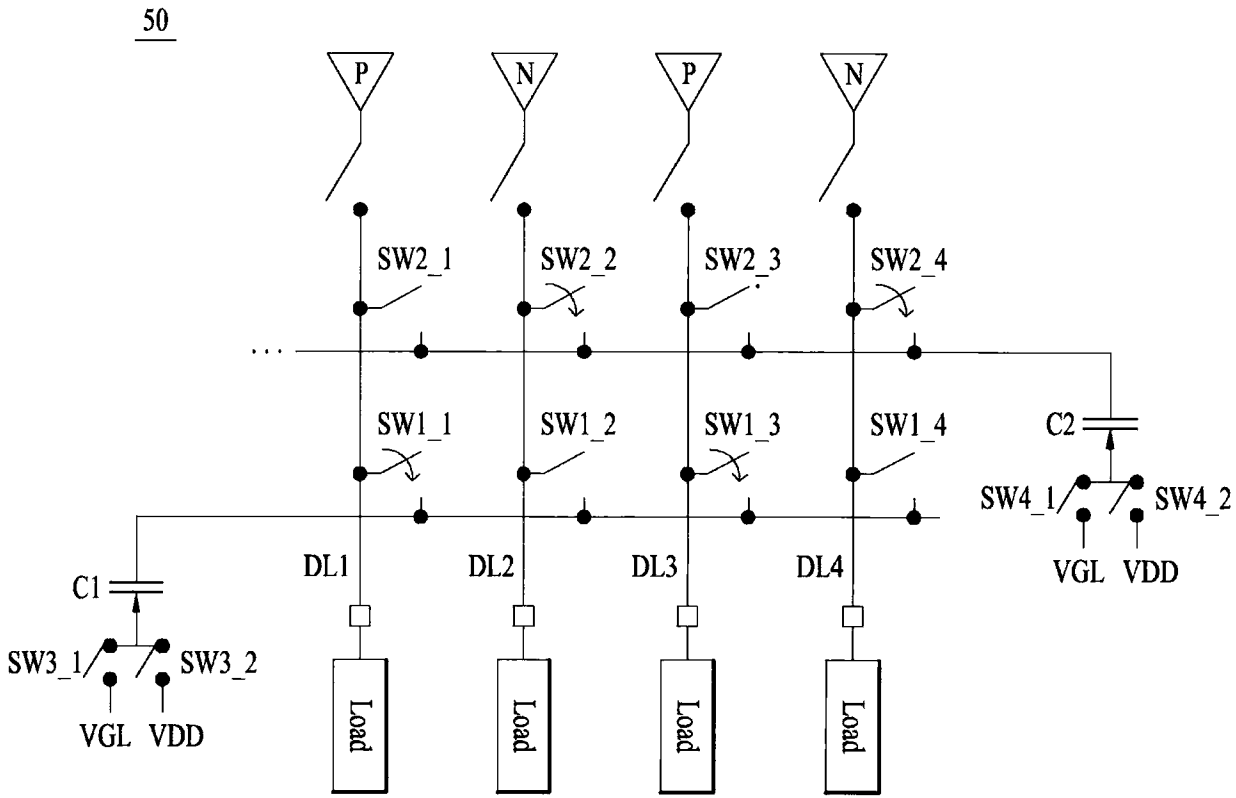
FIG. 2 is a circuit diagram illustrating a more concrete embodiment of a charge sharing unit included in the display device of FIG. 1.

FIG. 1 is a block diagram illustrating a configuration of a display device according to an embodiment of the present invention. FIG. 2 is a circuit diagram illustrating an embodiment of a charge sharing unit included in the display device of FIG. 1.

Referring to FIGS. 1 and 2, the display device according to the illustrated embodiment of the present invention includes a display panel 10, a gate driver 20, a data driver 30, a timing controller 40, and a charge sharing unit 50.

The display panel 10 includes pixels respectively formed at regions where a plurality of gate lines GL1 to GLn and a plurality of data lines DL1 to DLm intersect. These regions are defined as pixel regions. In this embodiment, it is assumed that the display panel 10 is a liquid crystal panel, each pixel of which is constituted by a liquid crystal cell. That is, although not shown, each pixel may be constituted by a thin film transistor formed at an intersection region between a gate line GL and a data line DL, and a liquid crystal cell, which selectively receives a data signal under control of the thin film transistor. The display panel 10 displays an image corresponding to a plurality data signals received via the plurality of data lines DL1 to DLm.

The gate driver 20 drives the plurality of gate lines GL1 to GLn. That is, the gate driver 20 sequentially supplies a scan signal to the plurality of gate lines GL1 to GLn under control of a gate control signal GCS output from the timing controller 40.

The data driver 30 drives the plurality of data lines DL1 to DLm. That is, the data driver 30 supplies a plurality of data signals to the plurality of data lines DL1 to DLm, respectively, whenever one gate line GL is activated, under control of a data control signal DCS output from the timing controller 40.

The timing controller 40 controls driving timing of the gate driver 20 and driving timing of the data driver 30. That is, the timing controller 40 generates the gate control signal GCS to control the gate driver 20 and the data control signal DCS to control the data driver 30, using at least two of synchronizing signals Vsync and Hsync, a data enable signal DE, and a clock signal CLK, which are supplied from an external system. The timing controller 40 also aligns data V_DATA supplied from the external system, and then supplies the aligned data V_DATA to the data driver 30. For reference, the gate control signal GCS includes a gate start pulse signal, a gate shift clock signal, and a gate output enable signal. Also, the data control signal DCS includes a source start pulse signal, a source shift clock signal, and a source output enable signal.

Meanwhile, the charge sharing unit 50 includes a first switching group 51, a second switching group 54, a third switching group 55, a first charger 52, and a second charger 53. For reference, the charge sharing unit 50 may be integrated in the data driver 30 or formed in the display panel 10.

The first switching group 51 selectively connects the plurality of data lines DL1 to DLm to the data driver 30. The first charger 52 is allocated to a first data line group of the plurality data lines DL1 to DLm, whereas the second charger 53 is allocated to a second data line group of the plurality data lines DL1 to DLm. That is, the second switching group 54 selectively connects the first data line group and the first charger 52, whereas the third switching group 55 selectively connects the second data line group and the second charger 53. Accordingly, the data lines DL1 to DLm are grouped into the first data line group and the second data line group in accordance with switching operations of the second switching group 54 and third switching group 55. Grouping into the data line groups is determined through control of the timing controller 40. In this embodiment, the data lines are grouped into an odd data line group and an even data line group. Grouping of the data lines may be varied in accordance with various embodiments.

The charge sharing unit 50 selectively performs charging and discharging operations between the first data line group and the first charger 52 and charging and discharging operations between the second data line group and the second charger 53 under control of the timing controller 40. In this case, a positive control voltage VDD and a negative control voltage VGL are selectively applied to the first charger 52 and second charger 53, to enable a voltage boosting operation to be carried out at a particular point of time. For reference, the positive control voltage VDD is a voltage having a positive voltage level. In this embodiment, a supply voltage supplied from an external voltage source is used as the positive control voltage VDD. Also, the negative control voltage VGL is a voltage having a ground or negative voltage level. In this embodiment, a negative voltage for pull-down driving the gate lines is used as the negative control voltage VGL.

Figure 3:
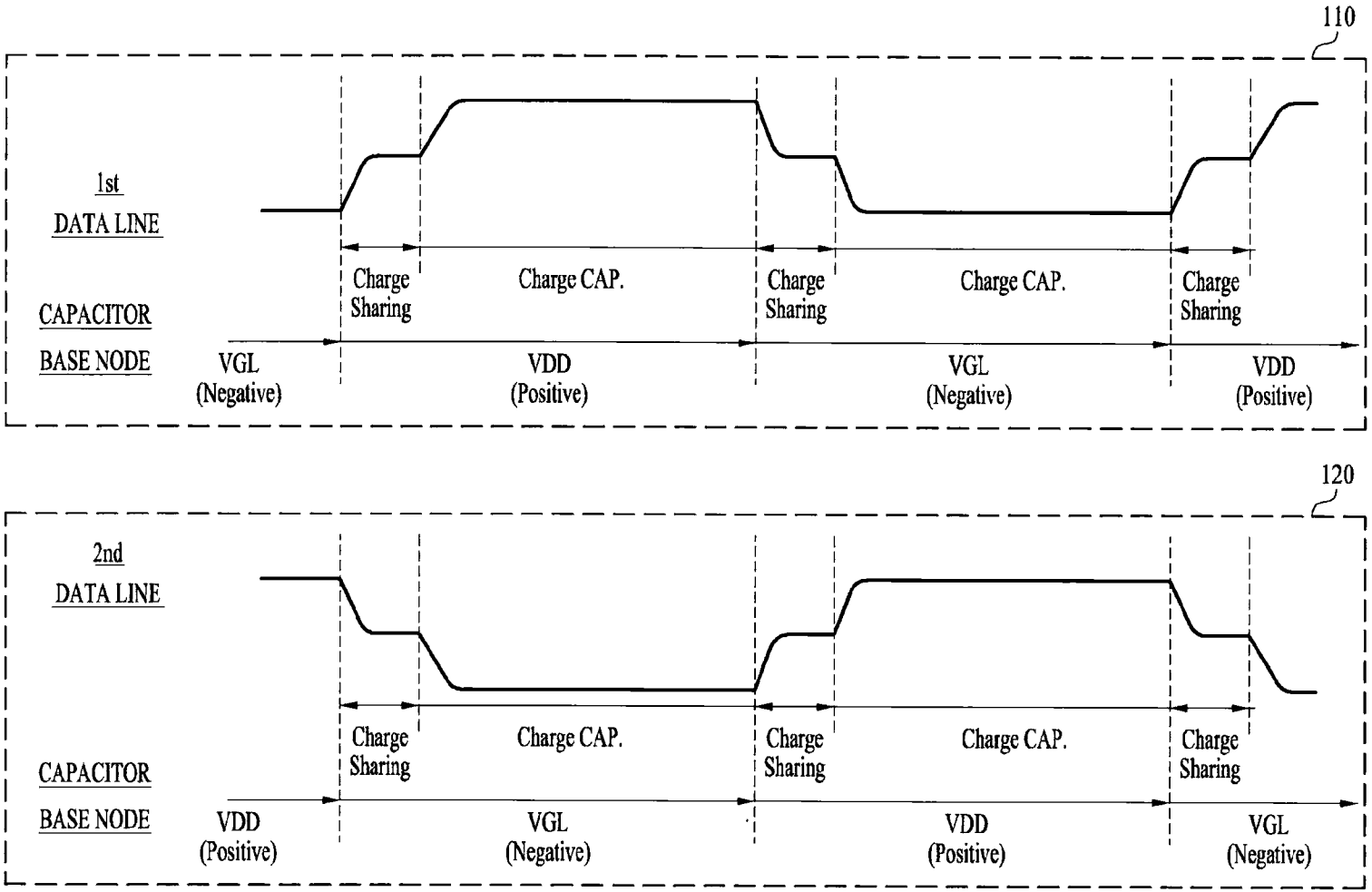
FIG. 3 is a timing diagram illustrating principal operations of the display device according to the illustrated embodiment of the present invention.

FIG. 3 is a timing diagram illustrating principal operations of the display device according to the illustrated embodiment of the present invention.

Hereinafter, detailed configurations and principal operations of the display device and charge sharing unit 50 according to the illustrated embodiment of the present invention will be described in more detail with reference to FIGS. 1 to 3.

Referring to FIG. 2, the first data line DL1 and the third data line DL3 are grouped into a first data line group, whereas the second data line DL2 and the fourth data line DL4 are grouped into a second data line group. That is, the first data line DL1 and third data line DL3 are defined as the first data line group because first and third switches SW1_1 and SW1_3 of the second switching group 54 turn on. Also, the second data line DL2 and fourth data line DL4 are defined as the second data line group because second and fourth switches SW_2 and SW_4 of the third switching group 55 turn on.

When active in a first switching mode (i.e., that illustrated in FIG. 2), the first switching group 51 supplies a positive data signal P to the first data line group and, at the same time, a negative data signal N to the second data line group. Subsequently, in a second switching mode (i.e., with the positive data signal P changed to negative data signal N and vice versa), the negative data signal N is supplied to the first data line group and, at the same time, the positive data signal P is supplied to the second data line group. That is, the positive and negative data signals are alternately supplied to the first data line group and second data line group.

After (or prior to) activating the first switching group 51 in either mode, the charge unit 50 minimizes the potential difference between the positive data signal P or the negative data signal N and a given data line's potential by coupling a charger 52, 53, to the data line. More specifically, charge sharing unit 50 lowers the first data line group, to which the positive data signal has been supplied (i.e., after the first switching mode), to a level lower than the positive data signal, but higher than the negative data signal, using the first charger 52, for a period between points of time when respective positive and negative data signals are alternately supplied to the first and second data line groups. In turn, the charge sharing unit 50 raises the second data line group (i.e., after the first switching mode), to which the negative data signal has been supplied, to a level higher than the negative data signal, but lower than the positive data signal, using the second charger 53. That is, the charge sharing unit 50 supplies intermetiate voltages to the first and second data line groups at levels between the level of the positive data signal and the level of the negative data signal (typically, the intermediate voltage levels are between the levels of the positive and negative data signals) in accordance with a charge sharing operation. Accordingly, when the positive and negative data signals are again driven onto the first and second data line groups, current consumption may be reduced in accordance with reduced swing of the signals. Thus, power consumption of the display device may be decreased.

The first charger 52 is coupled, at one end thereof, to the first data line group. The first charger 52 selectively receives, at the other end thereof, the positive control voltage VDD or the negative control voltage VGL. The first charger 52 includes a first capacitor C1 coupled, at one end thereof, to the first data line group, and one or more switches SW3_1, SW3_2 for applying an intermediate voltage when active. In the illustrated example, a plurality of first switches SW3_1 and SW3_2 selectively apply the positive control voltage VDD and negative control voltage VGL to the other end of the first capacitor C1, respectively.

The second charger 53 is coupled, at one end thereof, to the second data line group. The second charger 53 selectively receives, at the other end thereof, the positive control voltage VDD or the negative control voltage VGL. The second charger 53 includes a second capacitor C2 coupled, at one end thereof, to the second data line group, and one or more switches SW4_1, SW4_2 for applying an intermediate voltage when active. In the illustrated example, a plurality of second switches SW4_1 and SW4_2 selectively apply the positive control voltage VDD and negative control voltage VGL to the other end of the second capacitor C2, respectively.

Hereinafter, a charge sharing operation 110 carried out between the first data line group and the first charger 52 will be described in detail.

First, it is assumed that the negative control voltage VGL has been applied to the other end of the first capacitor C1, and the negative data signal has been supplied to the first data line group.

When the positive control voltage VDD is subsequently applied to the other end of the first capacitor C1, the voltage level of one end of the first capacitor C1, namely, a node coupled to the first data line group, is boosted in a positive direction in accordance with a charge pumping operation. That is, charge sharing is carried out between the first capacitor C1 and the first data line group, thereby causing the voltage level of the first data line group to be raised to a predetermined level.

When the positive data signal is subsequently supplied to the first data line group, the voltage level of the first data line group is further raised to the level of the positive data signal. In this case, the first capacitor C1 is charged to a predetermined level by the positive data signal.

When the negative control voltage VGL is applied to the other end of the first capacitor C1, the voltage level of one end of the first capacitor C1, namely, the node coupled to the first data line group, is boosted in a negative direction in accordance with a charge pumping operation. Accordingly, the voltage level of the first data line group is lowered to a predetermined level. That is, charge sharing is carried out between the first capacitor C1 and the first data line group, thereby causing the voltage level of the first data line group to be lowered to a predetermined level.

Also, a charge sharing operation 120 carried out between the second data line group and the second charger 52 will be described in detail hereinafter.

First, it is assumed that the positive control voltage VDD has been applied to the other end of the second capacitor C2, and the positive data signal has been supplied to the second data line group.

When the negative control voltage VGL is subsequently applied to the other end of the second capacitor C2, the voltage level of one end of the second capacitor C2, namely, a node coupled to the second data line group, is boosted in a negative direction in accordance with a charge pumping operation. That is, charge sharing is carried out between the second capacitor C2 and the second data line group, thereby causing the voltage level of the second data line group to be lowered to a predetermined level.

When the negative data signal is subsequently supplied to the second data line group, the voltage level of the second data line group is further lowered to the level of the negative data signal. In this case, the second capacitor C2 is charged to a predetermined level by the negative data signal.

When the positive control voltage VDD is applied to the other end of the second capacitor C2, the voltage level of one end of the second capacitor C2, namely, the node coupled to the second data line group, is boosted in a positive direction in accordance with a charge pumping operation. Accordingly, the voltage level of the second data line group is raised to a predetermined level. That is, charge sharing is carried out between the second capacitor C2 and the second data line group, thereby causing the voltage level of the second data line group to be raised to a predetermined level.

In one embodiment, the charging levels of the first capacitor C1 and second capacitor C2 are varied in accordance with the levels of the positive data signal and negative data signal. Accordingly, it may be possible to prevent the voltage of the data lines from being excessively raised or lowered after charge sharing, even when the levels of the positive data signal and negative data signal are varied. That is, the charging amounts of the first capacitor C1 and second capacitor C2 are adjusted relative to each other and, as such, it may be possible to reduce unnecessary current consumption, as compared to the case in which charge sharing of an absolute level is carried out. Thus, power consumption of the display device may be decreased.

In this embodiment, as the first control voltage, which is applied to the first charger 52, the positive control voltage VDD and negative control voltage VGL are used in each operation period. Also, as the second control voltage, which is applied to the second charger 53, the positive control voltage VDD and negative control voltage VGL are used in each operation period. In this case, the voltages used as the first and second control voltages may have various levels and kinds in accordance with various embodiments.

The above-described display device, which includes the first charger electrically connected to the first data line group of the plurality data lines, and the second charger electrically connected to the second data line group of the plurality data lines, is driven through the steps of applying the positive control voltage to the first charger, thereby raising the voltage level of the first data line group, driving the positive data signal onto the first data line group, applying the negative control voltage to the first charger, thereby lowering the voltage level of the first data line group, and driving the negative data signal onto the first data line group. Also the display device is driven through the steps of applying the negative control voltage to the second charger, thereby lowering the voltage level of the second data line group, driving the negative data signal onto the second data line group, applying the positive control voltage to the second charger, thereby raising the voltage level of the second data line group, and driving the positive data signal onto the second data line group.

Consequently, the display device according to the illustrated embodiments of the present invention may perform charge sharing within a reduced time, through chargers allocated to respective data line groups, and thus may reduce current consumption occurring upon driving of data signals. Voltage boosting is carried out in accordance with selective application of positive and negative control voltages to the charger allocated to each data line group. Accordingly, more rapid charge sharing may be achieved.

As apparent from the above description, the display device and the method for driving the same according to the present invention have the following effects.

That is, it may be possible to perform charge sharing within a reduced time, through chargers allocated to respective data line groups, and thus to reduce current consumption occurring upon driving of data signals.

Voltage boosting is carried out in accordance with selective application of positive and negative control voltages to the charger allocated to each data line group. Accordingly, more rapid charge sharing may be achieved.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A display device comprising:

a display panel for displaying an image corresponding to a plurality of data signals transferred via a plurality of data lines;

a data driver for driving the plurality of data lines;

a timing controller for controlling driving timing of the data driver; and a charge sharing unit comprising:

a first charger including a first capacitor storing charges, a first end of the first capacitor allocated to a first data line group of the plurality of data lines, and a second end of the first capacitor selectively coupled to a positive control voltage and a negative control voltage, and a second charger including a second capacitor storing charges, a first end of the second capacitor allocated to a second data line group of the plurality of data lines, and a second end of the second capacitor selectively coupled to the positive control voltage and the negative control voltage, wherein:

the charge sharing unit selectively performs charging and discharging operations between the first data line group and the first charger and charging and discharging operations between the second data line group and the second charger under control of the timing controller, responsive to the second end of the first capacitor being coupled to the positive control voltage, a voltage of the first end of the first capacitor being boosted in a positive direction from a first voltage corresponding to the charges stored in the first capacitor, responsive to the second end of the first capacitor being coupled to the negative control voltage, the voltage of the first end of the first capacitor being boosted in a negative direction from the first voltage corresponding to the charges stored in the first capacitor, responsive to the second end of the second capacitor being coupled to the positive control voltage, a voltage of the first end of the second capacitor being boosted in the positive direction from a second voltage corresponding to the charges stored in the second capacitor, and responsive to the second end of the second capacitor being coupled to the negative control voltage, the voltage of the first end of the second capacitor being boosted in the negative direction from the second voltage corresponding to the charges stored in the second capacitor.

2. The display device according to claim 1, wherein the charge sharing unit comprises:

a first switching group for selectively connecting the data driver and the plurality of data lines;

a second switching group for selectively connecting the first data line group and the first end of the first capacitor;

a third switching group for selectively connecting the second data line group and the first end of the second capacitor;

the first charger coupled to the first data line group via the second switching group and receiving a first control voltage for supplying or removing charge from the first data line group; and the second charger coupled to the second data line group via the third switching group and receiving a second control voltage for supplying or removing charge from the second data line group.

3. A method for driving a display device including a first charger and a second charger, the first charger including a first capacitor storing charges, a first end of the first capacitor electrically coupled to a first data line group of a plurality of data lines, and a second end of the first capacitor selectively coupled to a positive control voltage and a negative control voltage, the second charger including a second capacitor storing charges, a first end of the second capacitor electrically coupled to a second data line group of the plurality of data lines, and a second end of the second capacitor selectively coupled to the positive control voltage and the negative control voltage, the method comprising:

applying the positive control voltage to the second end of the first capacitor for raising a voltage level of the first data line group in a positive direction from a first voltage corresponding to the charges stored in the first capacitor, in accordance with the positive control voltage;

driving a positive data signal onto the first data line group;

applying the negative control voltage to the second end of the first capacitor for lowering the voltage level of the first data line group in a negative direction from a second voltage corresponding to the charges stored in the first capacitor, in accordance with the negative control voltage; and driving a negative data signal onto the first data line group.

4. The method according to claim 3, further comprising:

applying the negative control voltage to the second end of the second capacitor for lowering a voltage level of the second data line group in the negative direction from a third voltage corresponding to the charges stored in the second capacitor, in accordance with the negative control voltage;

driving the negative data signal onto the second data line group;

applying the positive control voltage to the second end of the second capacitor for raising the voltage level of the second data line group in the positive direction from a fourth voltage corresponding to the charges stored in the second capacitor, in accordance with the positive control voltage; and driving the positive data signal onto the second data line group.

* * * * *